US009327959B2

(12) United States Patent
Orita

(10) Patent No.: US 9,327,959 B2
(45) Date of Patent: May 3, 2016

(54) WATER DISPENSER

(75) Inventor: Yoshinori Orita, Kakogawa (JP)

(73) Assignee: KABUSHIKI KAISHA COSMO LIFE, Hyogo (JP)

( * ) Notice: Subject to any disclaimer, the term of this patent is extended or adjusted under 35 U.S.C. 154(b) by 0 days.

(21) Appl. No.: 14/381,656

(22) PCT Filed: Jul. 5, 2012

(86) PCT No.: PCT/JP2012/067191

§ 371 (c)(1),
(2), (4) Date: Sep. 29, 2014

(87) PCT Pub. No.: WO2013/128666

PCT Pub. Date: Sep. 6, 2013

(65) Prior Publication Data

US 2015/0060487 A1 Mar. 5, 2015

(30) Foreign Application Priority Data

Mar. 2, 2012 (JP) ..... 2012-046359

(51) Int. Cl.
*B67D 3/00* (2006.01)
*B67D 1/00* (2006.01)
*B67D 1/08* (2006.01)

(52) U.S. Cl.
CPC ..... *B67D 3/0029* (2013.01); *B67D 1/0004* (2013.01); *B67D 1/0804* (2013.01); (Continued)

(58) Field of Classification Search
CPC ..... B67D 3/0032; B67D 2001/0814; B67D 1/0895; B67D 2210/00023; B67D 1/0897; B67D 1/0857; B67D 1/0004; B67D 1/0891; B67D 1/0804; B67D 3/0067; B67D 3/0083; B67D 3/0035; B67D 3/0009; B67D 3/0022; B67D 3/0029; B67B 7/24
USPC ..... 222/146.1, 83, 81, 105, 160, 325
See application file for complete search history.

(56) References Cited

U.S. PATENT DOCUMENTS 4,958,747 A * 9/1990 Sheets ..... 222/67
5,048,723 A * 9/1991 Seymour ..... 222/81
(Continued)

FOREIGN PATENT DOCUMENTS

CN 2279133 4/1998
CN 202011738 10/2011
(Continued)

OTHER PUBLICATIONS

International Search Report issued Sep. 25, 2012 in International (PCT) Application No. PCT/JP2012/067191.
(Continued)

*Primary Examiner* — Frederick C Nicolas
*Assistant Examiner* — Robert Nichols, II
(74) *Attorney, Agent, or Firm* — Wenderoth, Lind & Ponack, L.L.P.

(57) ABSTRACT

A water dispenser includes a raw water container which can be slid into and out of a loading space, while being placed on a slide table. The slide table has a container holder adapted to restrain the peripheral side wall of the raw water container. The minimum height and the shape of the container holder are determined such that when the peripheral side wall of the raw water container is collapsed, the raw water container is never pulled up by the container holder as a result of the peripheral side wall getting caught on the container holder, and such that when the raw water container becomes empty, the raw water container is received within the container holder. This prevents portions of the peripheral side wall from protruding into spaces behind front distal ends of side plates defining the loading space.

5 Claims, 6 Drawing Sheets

(52) U.S. Cl.
CPC ..... *B67D1/0891* (2013.01); *B67D 3/0009* (2013.01); *B67D 3/0022* (2013.01); *B67D 3/0032* (2013.01); *B67D 3/0035* (2013.01); *B67D 3/0038* (2013.01); *B67D 3/0067* (2013.01); *B67D 3/0083* (2013.01); *B67D 1/0857* (2013.01); *B67D 1/0895* (2013.01); *B67D 1/0897* (2013.01); *B67D 2001/0814* (2013.01); *B67D 2210/00023* (2013.01)

(56) References Cited

U.S. PATENT DOCUMENTS

| | | | | |
|---|---|---|---|---|
| 5,272,881 | A | 12/1993 | Lee | |
| 6,926,170 | B2 * | 8/2005 | Groesbeck | 222/63 |
| 2003/0012586 | A1 * | 1/2003 | Iwata et al. | 399/258 |
| 2006/0071029 | A1 * | 4/2006 | Orita | 222/185.1 |
| 2010/0116847 | A1 * | 5/2010 | Foroughi et al. | 222/81 |
| 2011/0163116 | A1 * | 7/2011 | Dixon | 222/1 |
| 2012/0055953 | A1 | 3/2012 | Shiotani et al. | |

FOREIGN PATENT DOCUMENTS

| | | |
|---|---|---|
| CN | 102245496 | 11/2011 |
| JP | 2001-153523 | 6/2001 |
| JP | 2005-082168 | 3/2005 |
| JP | 2008-273605 | 11/2008 |
| JP | 2010-228807 | 10/2010 |
| JP | 2010-285203 | 12/2010 |
| JP | 2011-111228 | 6/2011 |
| JP | 4802299 | 10/2011 |
| WO | 2009/059405 | 5/2009 |
| WO | 2011/011690 | 1/2011 |

OTHER PUBLICATIONS

Chinese Office Action issued Dec. 3, 2015 in corresponding Chinese Application No. 2012800719786 (with English translation).

* cited by examiner

WATER DISPENSER

TECHNICAL FIELD

This invention relates to a water server (water dispenser) which can discharge drinking water transferred beforehand from an exchangeable raw water container into a water storage tank.

BACKGROUND ART

Such water dispensers are configured such that when a lever or a cock is operated by a user to open a valve in a water discharge line, water in the water storage tank can be discharged through the water discharge line into e.g. a user's cup. One of such conventional water dispensers is configured such that the raw water container is placed at the lower portion of the casing, with the water storage tank provided at a level higher than the raw water container. With this arrangement, when the empty raw water container is exchanged with a new one, an operator does not have to lift the heavy new raw water container to a high level, so that it is possible to save the labor of the operator. Since the water storage tank is located at a level higher than the raw water container, this water dispenser includes a water supply line through which water in the raw water tank can be lifted to the water storage tank. When water in the water storage tank decreases, a pump is configured to be automatically activated to lift water in the raw water container to the water supply tank until water in the water storage tank reaches a predetermined amount (see JP Patent Publication 2001-153523A (especially paragraphs [0021] and and FIGS. 2 and 3), and JP Patent 4802299).

The water dispenser disclosed in JP Patent Publication 2001-153523A includes a casing having a loading space at its lower portion, a slide table, an exchangeable raw water container which can be moved into and out of the loading space, while being placed on the slide table, a water storage tank mounted in the casing, and a water supply line through which water in the raw water container is to be drawn up and supplied into the water storage tank. The casing includes right and left side plates defining the loading space. The side plates have front distal end portions, respectively, which are bent toward each other, for increased rigidity. The raw water container is placed on the top surface of the slide table with its mouth facing upward. The water supply line has a first end portion which can be pushed into the mouth of the container from over the mouth.

In the water dispenser disclosed in JP Patent 4802299, which is of the type in which the raw water container is placed on the slide table in the upside down position, the slide table has a piercing portion configured to push up the plug of the raw water container into the container. The piercing portion includes the first end portion of the water supply line. Ordinarily, the plug of the raw water container is pushed up by the piercing portion by lifting the raw water container in the upside down position and then lowering the container while kept in contact with the piercing portion. Or otherwise, the piercing portion may be raised toward the raw water container, which is kept stationary over the piercing portion, as disclosed in JP Patent 4802299.

Some of the raw water containers used in these water dispensers are hard bottles, while others are soft containers having a peripheral side wall which is collapsible under the atmospheric pressure when water in the container decreases. Soft raw water containers can be transported easily after they become empty.

If a soft container is used as the raw water container as disclosed in JP Patent Publication 2001-153523A, while the raw water container is collapsed substantially in the vertical direction as water in the container decreases, if the peripheral side wall 101 of the raw water container 100 is collapsed in an uneven manner for one reason or another as shown in FIG. 7 or 8, the peripheral side wall 101 could partially protrude into spaces behind front distal ends 102*a* of the side plates 102. If this happens, when the slide table 103 is pulled out of the loading space, the protruding portions of the peripheral side wall 101, whose rigidity is high because it is collapsed, will get caught on one or both of the front distal ends 102*a*, thus making it difficult to pull out the slide table 103.

SUMMARY OF THE INVENTION

An object of the present invention is to prevent the peripheral side wall of the raw water container, which has been collapsed and has become empty, from getting caught on either of the front distal end portions of the side walls defining the loading space of the casing, when the slide table is pulled out of the loading space.

In order to achieve this object, according to the present invention, the slide table includes a container holder configured to restrain right and left sides of the peripheral side wall of the raw water container when the raw water container is placed on the slide table, and the minimum height and the shape of the container holder are determined such that when the peripheral side wall of the raw water container is collapsed, the raw water container is never pulled up by the container holder as a result of the peripheral side wall getting caught on the container holder, and such that when the raw water container becomes empty, the raw water container is received within the container holder. With this arrangement, even if the peripheral side wall of the raw water container is collapsed unevenly either rightwardly or leftwardly, the container holder restrains the peripheral side wall such that the peripheral side wall is received within the container holder by the time the container becomes empty. This prevents the container holder from getting caught on either of the front distal ends of the side plates. If the peripheral side wall protrudes over the container holder and gets caught on the container holder when the peripheral side wall is collapsed, when the container is further collapsed, the container hangs from its portion caught on the container holder and is thus pulled upward. This makes it impossible for the container holder to restrain the peripheral side wall until the raw water container becomes empty. This trouble is reliably avoidable by using a container holder having a sufficiently high minimum height and having no edges, protruding ends or steps that could catch the peripheral side wall when the peripheral side wall is collapsed. As used herein, the "right-and-left direction" refers to the horizontal direction perpendicular to the direction in which the slide table is slid into and out of the loading space; the "height" refers to the height from the ground, unless otherwise specified; and the "vertical direction" refers to the direction perpendicular to a horizontal plane.

According to the present invention too, the slide table may have a piercing portion which can push the plug of the raw water container upwardly into the container, and the piercing portion may include a first end portion of the water supply line. Since the minimum height and the shape of the container holder are determined such that when the peripheral side wall of the raw water container is collapsed, the raw water container is never pulled up by the container holder as a result of the peripheral side wall getting caught on the container holder, leakage of water is prevented due to reduced contact pressure between the mouth of the container and the piercing portion as a result of the mouth of the container being pulled up relative to the piercing portion when the raw water container is pulled up. Thus, it is possible to use a connecting structure using the conventional piercing portion.

The minimum height of the container holder is preferably determined so as to be not higher than the peripheral side wall of the raw water container when water in the raw water container is initially drawn out. Any portion of the container holder that is higher than the peripheral side wall when water is initially drawn out from the container is useless because it is not used to restrain the peripheral side wall. Preferably, by limiting the minimum height of the container holder to not more than the upper limit of the effective restricting range (namely, the height of the peripheral side wall when water is initially drawn out from the raw water container), the height to which a brand-new raw water container has to be lifted over the container holder is reduced. This arrangement is used in a water dispenser including an exchangeable raw water container set in the upside down position, a water supply line through which water in the raw water container is to be fed into the water storage tank, a water discharge line through which water in the water storage tank is to be discharged, and a piercing portion configured to push up the plug of the raw water container into the container, with the piercing portion including a first end portion of the water supply line, wherein the raw water container is the above-described soft container, and further including a container holder configured to restrain the peripheral side wall of the raw water container with the container placed in the upside down position from around the peripheral side wall, to reduce the above-mentioned water leakage and to reduce the height to which a new raw water container has to be lifted.

If the piercing portion is used, for easy alignment of the mouth of the raw water container with the piercing portion when the container is lifted to a position over the piercing portion, the mouth of the container is preferably arranged such that when the raw water container is positioned upside down, the mouth protrudes downwardly from the remaining portion of the raw water container. In this case, when placing the raw water container on the slide table, the container is lifted over the container holder so as to be located over the piercing portion, while being kept in the upside down position. By providing the lowest intermediate portions of the container holder on the right and left sides of, and above, the mouth of the raw water container with the container placed on the slide table in the upside down position, the operator can easily align the mouth of the container with the connecting port with reference to one of the lowest intermediate portions. Thus, the mouth can be easily set in the connecting port. Also, it is not necessary to lift the raw water container to so high a level.

As described above, the present invention provides a water dispenser comprising a casing having a loading space at the lower portion of the casing, a slide table, an exchangeable raw water container which can be moved into and out of the loading space, while being placed on the slide table, a water storage tank mounted in the casing, a water supply line through which water in the raw water container is to be drawn up and supplied into the water storage tank, and a water discharge line through which water in the water storage tank is to be discharged, wherein the loading space is defined by right and left side plates having front distal end portions, respectively, which are bent toward each other, wherein the raw water container is made of a soft material and having a peripheral side wall which is collapsible under an atmospheric pressure when water in the raw water container decreases, wherein the slide table includes a container holder configured to restrain right and left sides of the peripheral side wall of the raw water container when the raw water container is placed on the slide table, wherein the container holder has a minimum height and a predetermined shape, and wherein the minimum height and the predetermined shape are determined such that when the peripheral side wall of the raw water container is collapsed, the raw water container is never pulled up by the container holder as a result of the peripheral side wall getting caught on the container holder, and such that when the raw water container becomes empty, the raw water container is received within the container holder. With this arrangement, when the slide table is pulled out of the loading space of the casing in order to exchange the used raw water container with a new one, it is possible to prevent the peripheral side wall of the used raw water container, which is empty and has been collapsed, from getting caught on the front distal ends of the side plates defining the loading space.

BRIEF DESCRIPTION OF THE DRAWINGS

FIG. 6(*b*) shows an operational state of the container holder when the raw water container has become empty.

DETAILED DESCRIPTION OF THE INVENTION

Figure 1:
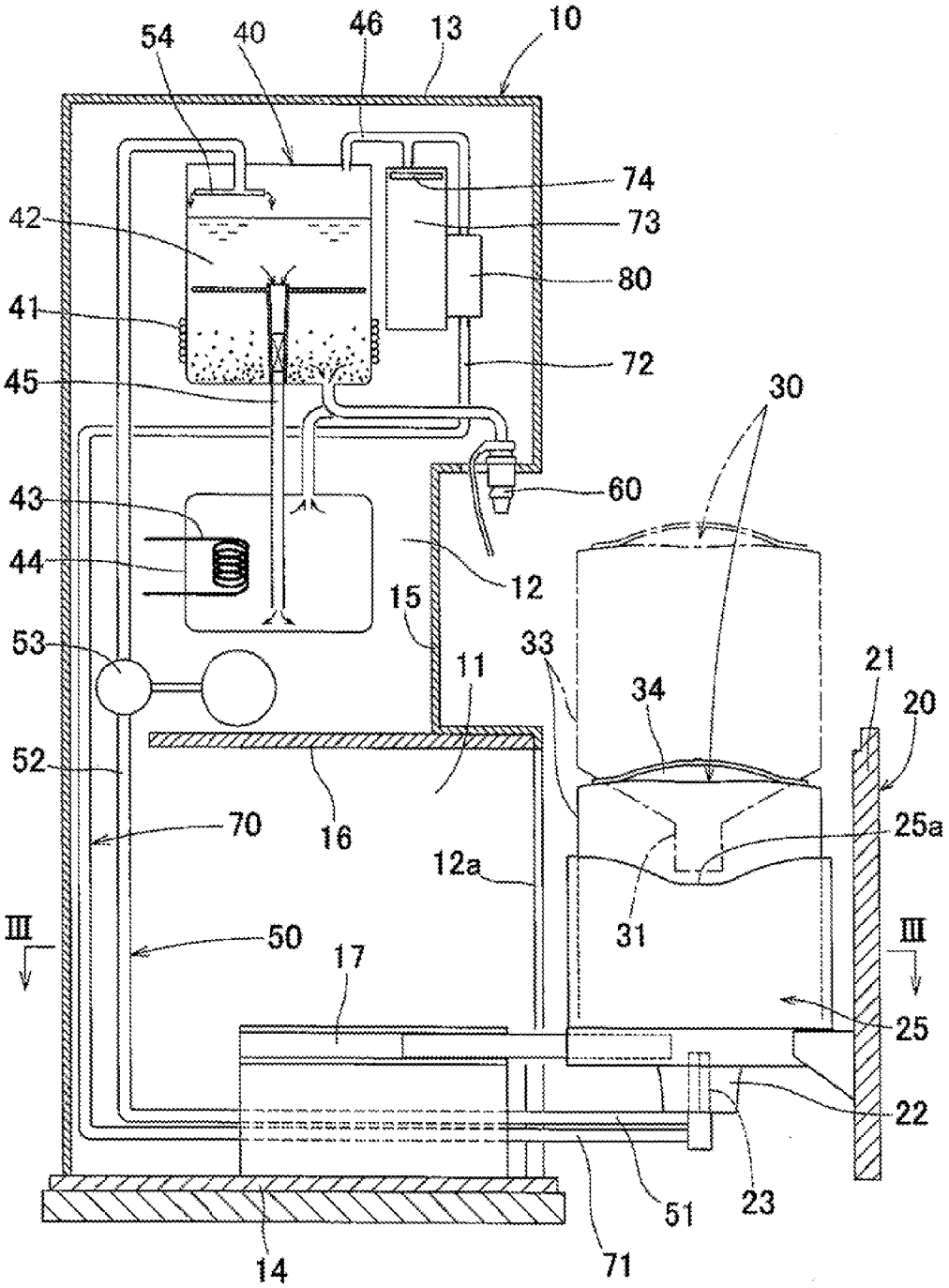
FIG. 1 schematically shows an embodiment of the present invention in its entirety.
Figure 2:
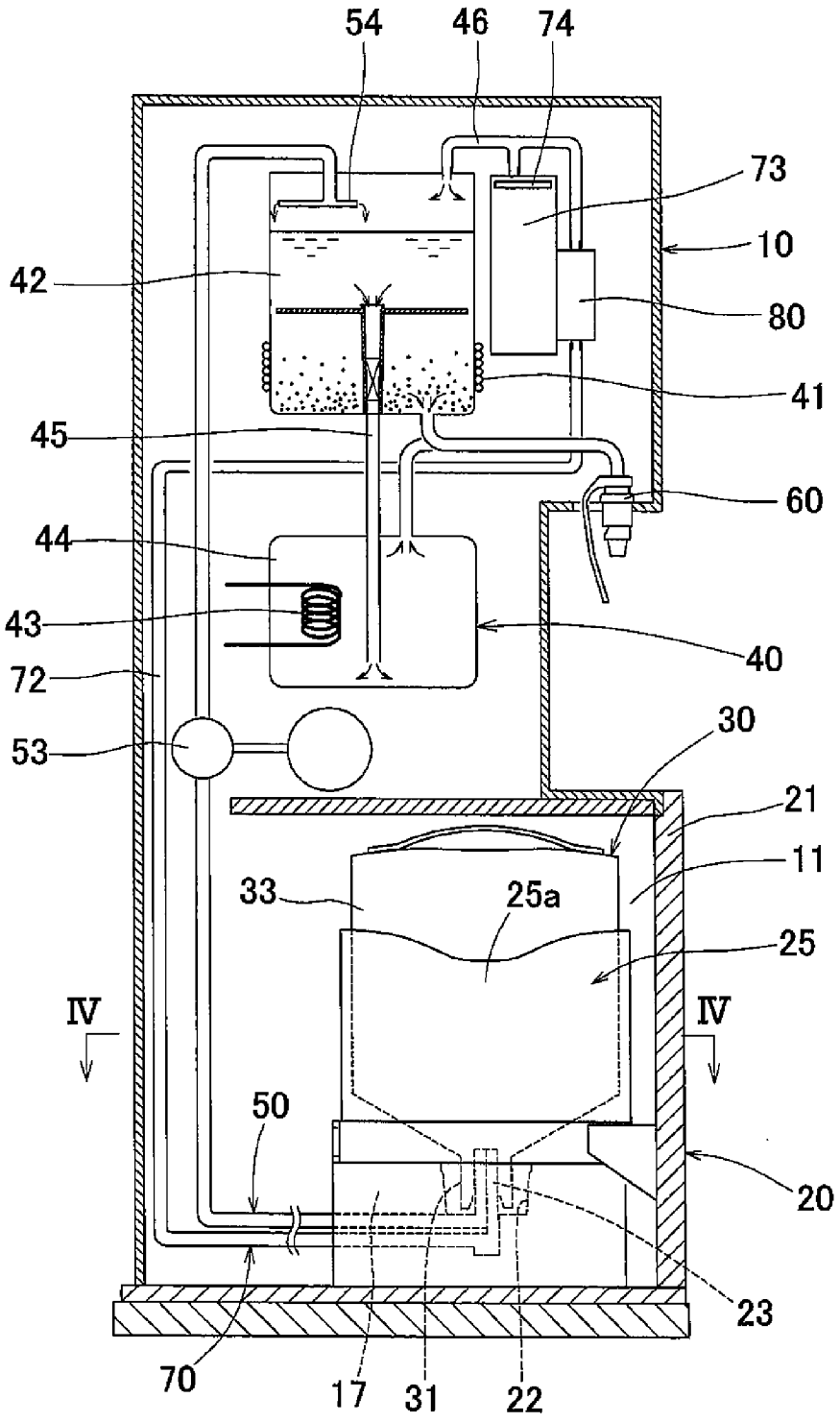
FIG. 2 schematically shows a state in which a slide table shown in FIG. 1 has been moved into a loading space.

A water dispenser embodying the present invention is now described with reference to the attached drawings. As illustrated in FIGS. 1 and 2, this water dispenser includes a casing 10 defining a loading space 11 at its lower portion, a slide table 20 which can be slid into and out of the loading space 11, an exchangeable raw water container 30 which can be slid into and out of the loading space 11 while being placed on the slide table 20, and a storage tank unit 40 mounted in the casing 10. The water dispenser further includes a water supply line 50 through which water in the raw water container 30 is drawn up into the storage tank unit 40, water discharge lines 60 through which water in the storage tank unit 40 is discharged, an air intake line 70 through which the interior of the raw water container 30 is in communication with the atmosphere, and a sterilizer 80 configured to mix sterilizing air into atmospheric air in the air intake line 70.

Figure 3:
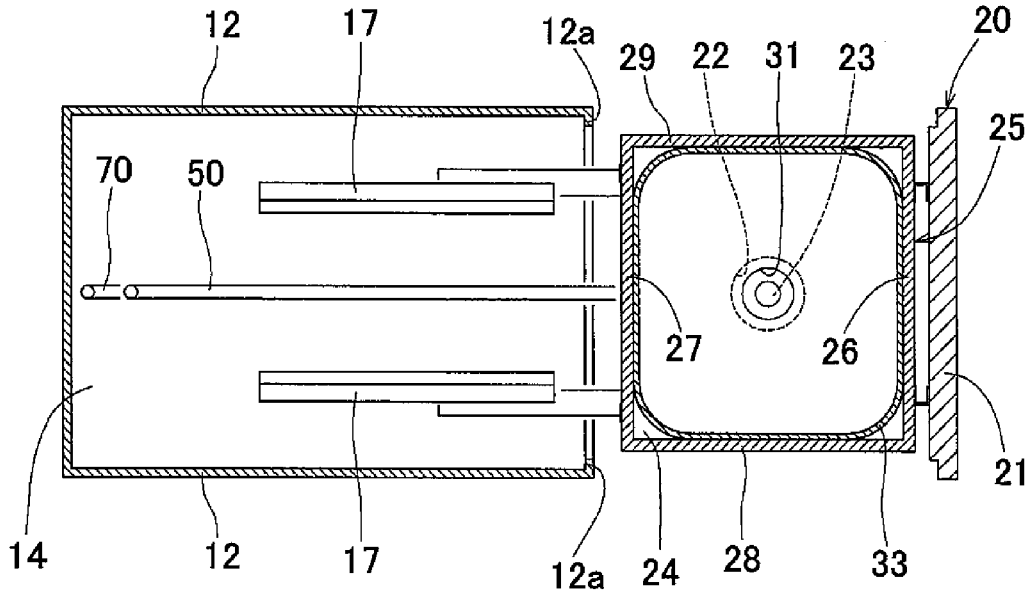
FIG. 3 is a sectional view taken along line III-III of FIG. 1.
Figure 4:
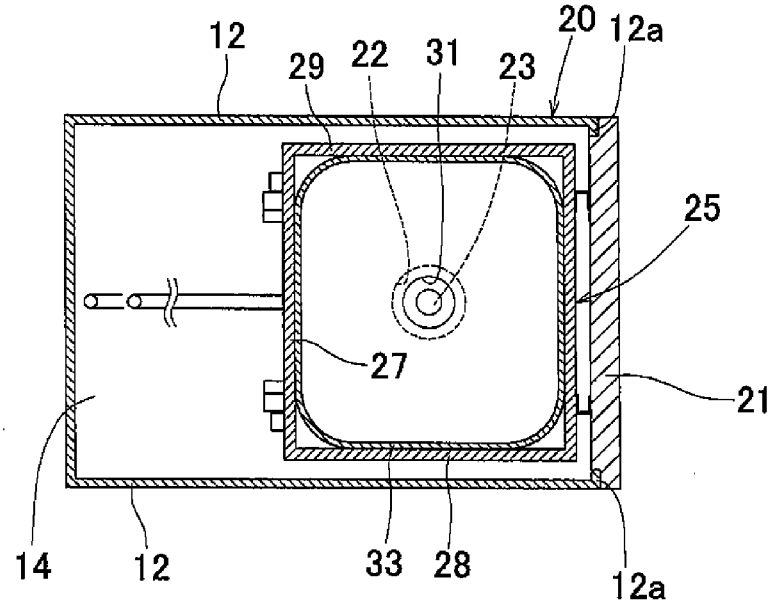
FIG. 4 is a sectional view taken along line IV-IV of FIG. 2.

As illustrated in FIGS. 1 and 3, the casing 10 is an upright casing comprising right and left side plates 12, and a top plate 13, a bottom plate 14, a front plate 15, and an intermediate plate 16 which all extend between the side plates 12. The loading space 11 is defined by the side plates 12, the bottom plate 14, the intermediate plate 16 and the lower portion of the front plate 15, and is configured to be covered with a front panel 21 of the slide table 20 as illustrated in FIGS. 2 and 4. In order to eliminate the necessity of lifting the raw water container 30 to the upper portion of the casing 10, as illustrated in FIGS. 1 and 2, the loading space 11 is provided at the lower portion of the casing 10 so that the slide table 20 can be slid into and out of the loading space 11. As used herein, "the lower portion of the casing 10" refers to the portion of the casing lower than the middle of the vertical length of the casing 10. As illustrated in FIGS. 3 and 4, the side plates 12 have front distal end portions 12*a* bent toward each other, namely toward the interior of the loading space 11, with the front sides of the distal end portions facing the back side of the e front panel 21 of the slide table 20.

As shown in FIG. 1, the water storage tank unit 40 is configured to adjust the temperature of water stored therein, and is provided at a level higher than the loading space 11. The water storage tank unit 40 includes a cold water tank 42 having a heat exchanger 41 for cooling the water in the cold water tank 42, a warm water tank 44 having a heater 43 for heating the water in the warm water tank 44, and a water transfer line 45. The water transfer line 45 is provided at a baffle plate which interferes with the downward flow of water supplied from the water supply line 50. Water drawn up from the raw water container 30 through the water supply line 50 is fed into the cold water tank 42, and then a portion of water in the cold water tank 42 at the upper portion of the cold water tank 42 flows into the warm water tank 44 through the water transfer line 45.

There are provided two of the water discharge lines 60 independent of each other with one of them connected to the cold water tank 42 and the other connected to the warm water tank 44. Valves (not shown) are provided at the boundaries between the respective two water discharge lines 60 and the water storage tank unit 40 so that when one of the valves is opened by a user, a bottom portion of water in the cold water tank 42 or a top portion of water in the warm water tank 44 can be discharged into e.g. a cup. One of the cold water tank and the warm water tank of the water storage tank unit 40 may be omitted.

Figure 5:
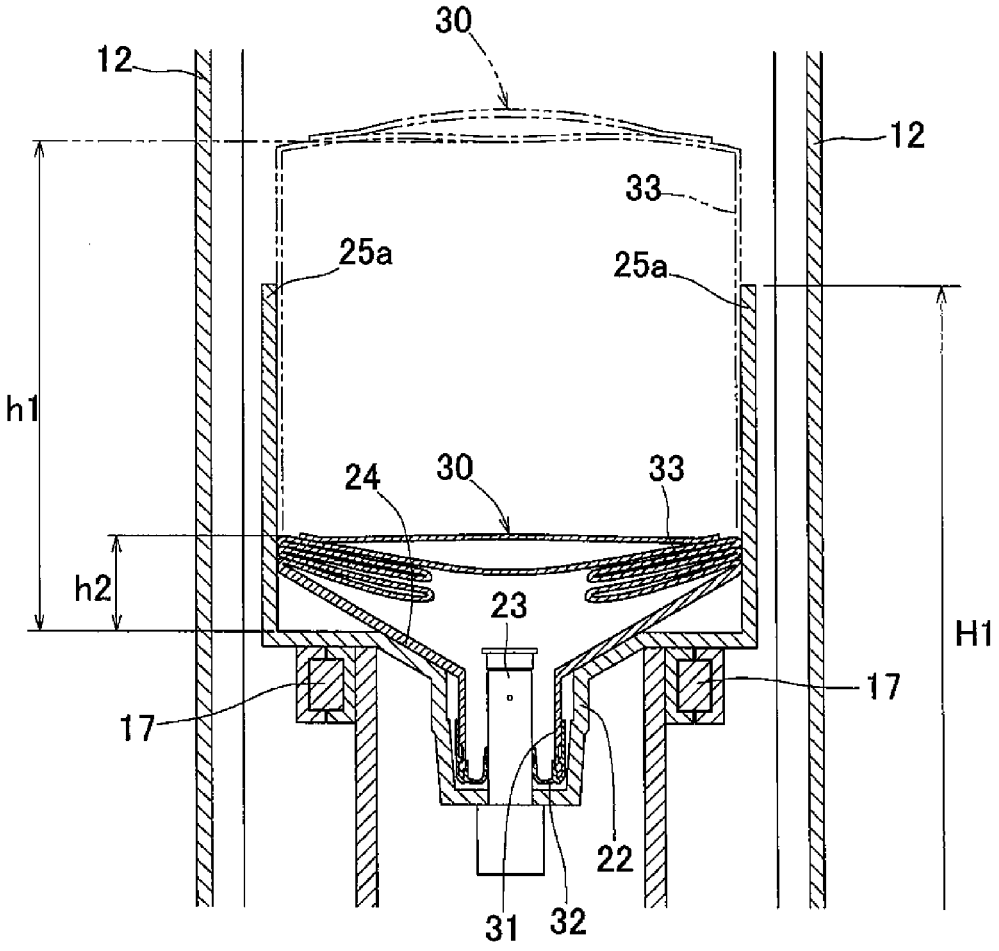
FIG. 5 is a partial sectional view of the embodiment taken along line V-V of FIG. 6(*a*), showing how a raw water container is collapsed.

As shown in FIGS. 1, 3 and 4, the slide table 20 is slidable in a straight line in a horizontal direction relative to the casing 10 along guide rails 17 erected on the bottom plate 14 of the casing 10. The direction in which the slide table 20 slides corresponds to the "back-and-forth" direction of the water dispenser. As shown in FIGS. 2, 4 and 5, the slide table 20 includes a connecting port 22 into which the mouth 31 of the raw water container 30 can be inserted, a piercing portion 23 which can push up a plug 32 of the raw water container 30, and a seating portion 24 on which the raw water container 30 is seated. The interior of the piercing portion 23 is divided into a first end portion of the water supply line 50 and a first end portion of the air intake line 70. The water supply line 50 and the air intake line 70 have joint portions provided on the slide table 20. As shown in FIG. 1, connecting pipes 51 and 71 are connected at their first ends to the respective joint portions. The connecting pipes 51 and 71 are connected at their second ends to first ends of a water lifting pipe 52 and a vertically extending pipe 72, respectively. The connecting pipes 51 and 71 may e.g. be soft flexible pipes which are deformable when the slide table 20 is slid into and out of the casing. A pump 53 is mounted in an intermediate portion of the water lifting pipe 52. The pump 53 may be e.g. a plunger pump or a gear pump. The water supply line 50 has a second end 54 through which water drawn up by the pump 53 is fed into the cold water tank 42. The second end 54 is located at a level higher than a predetermined upper limit of the water level in the cold water tank 42. The vertically extending pipe 72 has a second end connected to an air chamber 73. The air intake line 70 has a second end portion 74 which is in the form of an atmospheric air intake port of the air chamber 73, which communicates with the atmosphere. The interior of the raw water container 30 is in communication with the atmosphere through the air intake line 70 at all times. A filter is preferably attached to the second end portion 74 of the air intake line 70 to remove contaminants in atmospheric air, such as dust, odors and bacteria.

The sterilizer 80 is configured to mix sterilizing gas into atmospheric air in the air intake line 70 and in the air chamber 73. The sterilizer 80 may be an ozone generator which generates ozone from oxygen in atmospheric air taken in. The sterilizer 80 is activated in operative association with the pump 53. An air introducing pipe 46 is connected to the water storage tank unit 40 at a level higher than the upper limit of the water level in the water storage tank unit 40. The air introducing pipe 46 is in communication with the vertically extending pipe 72 and the air chamber 73 at all times, whereby when the water level in the water storage tank unit 40 falls, atmospheric air containing sterilizing gas can be drawn into the water storage tank unit 40 from the air chamber 73, which is kept at the atmospheric pressure, through the air introducing pipe 46.

As shown in FIG. 5, the raw water container 30 is made of a soft material, and has a peripheral side wall 33 which is collapsible under the atmospheric pressure as water remaining in the container decreases. As shown in FIGS. 4 and 5, the peripheral side wall 33 is a wall portion which can define an inner wall surface and an outer wall surface on a horizontal plane of the inner space of the raw water container 30 (space in which water can be stored and from which water can be discharged). The mouth 31 of the raw water container 30 comprises a wall portion configured to define an opening of the raw water container 30 and to be pressed against the outer periphery of the piercing portion 23, when the piercing portion 23 is pierced through the plug 32. As shown in FIG. 5, since this raw water container 30 is configured such that with the plug 32 fitted around the tubular portion of the container, which is formed by drawing the peripheral side wall 33, the piercing portion 23 is pierced through the plug 32 to open the container, the shape of the opening of the container is determined by the tubular portion of the peripheral side wall 33 and the plug 32. That is, the mouth 31 of the container comprises the tubular portion of the peripheral side wall 33 and the plug 32, and is configured to protrude downwardly from the remaining portion of the container with the container positioned upside down. The peripheral side wall 33 is deformed such that its portions are folded one over another and its height decreases. As shown in FIG. 1, the raw water container 30 has a grip 34 on its top surface so that the container 30 can be lifted up by holding the grip 34. The raw water container 30 is made of synthetic resin in its entirety. The peripheral side wall 33 and the grip 34 are made of a transparent resin so that the mouth 31 of the container and the piercing portion 23 can be seen through the peripheral side wall 33 of the container and the grip 34 and thus can be easily positioned relative to each other.

As shown in FIGS. 1 and 3, with the slide table 20 slid out of the loading space 11, the raw water container 30 can be seated on the seating portion 24 of the slide table 20 by lowering the container 30 from over the seating portion 24 in the upside down position. When the mouth 31 of the container is inserted into the connecting port 22, the piercing portion 23, which protrudes upwardly in the connecting port 22, abuts the central portion of the plug 32. When the raw water container 30 is further lowered in this state, the central portion of the plug 32 is pushed up by the piercing portion 23, so that the mouth 31 of the container opens as shown in FIG. 5. After the mouth 31 opens, the raw water container 30 is seated on the seating portion 24. When pushed up by the piercing portion 23, the central portion of the plug 32 is fitted on the tip of the piercing portion 23, which now protrudes upwardly in the raw water container 30, with the remainder of the plug 32 attached to the peripheral side wall 33. With the raw water container 30 set in the upside down position on the slide table 20, the container 30 remains in this position until the container 30 becomes empty. The piercing portion 23 shown is a stationary member, but a movable piercing member as shown in JP Patent 4802299 may be used instead.

FIG. 2 and the two-dot chain line in FIG. 5 show the state of the raw water container 30 in which water in the container has settled after the container has been set in position and no water has yet been drawn out of the container. The seated height of the peripheral side wall 33 of the raw water container 30 in this state is indicated by h1 in FIG. 5. As used herein, the "seated height" of the peripheral side wall 33 refers to the difference in height between the highest point of the seating portion 24 of the slide table 20 and the highest point of the peripheral side wall 33 with the peripheral side wall 33 seated on the seating portion 24. Solid line in FIG. 5 indicates the state of the raw water container 30 in which the container is empty in a normal sense. As used herein, "empty in a normal sense" indicates the state in which the water level in the raw water container 30 is at the lowest point of the opening of the first end portion of the water supply line 50, which is in the piercing portion 23. In FIG. 5, since the opening of the first end portion of the water supply line 50 is upwardly spaced apart from the raw water container 30 in order to prevent this opening from being closed by the above-mentioned central portion of the plug 32 when the central portion falls, when the container 30 becomes empty in the normal sense, a small amount of water remains in the container 30. Instead, however, the opening at the first end portion of the water supply line 50 may be provided at the same level as the portion of the plug 32 other than its central portion so that when the container becomes empty in a normal sensor, practically no water remains in the container. As will be apparent from the solid line and the two-dot chain line in FIG. 5, the seated height h2 of the peripheral side wall 33 when the raw water container 30 becomes empty in the normal sense is significantly smaller than the seated height h1.

Figure 6A:
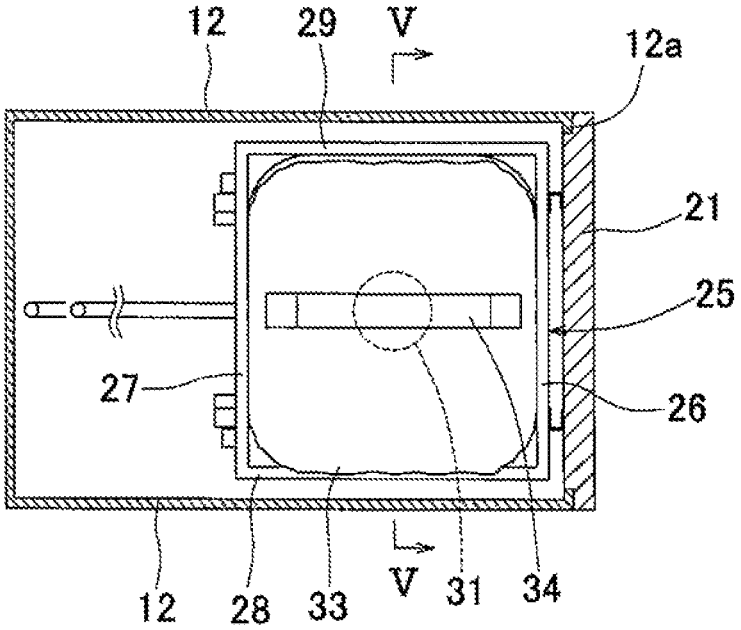
FIG. 6(*a*) shows an operational state of a container holder while the raw water container of the embodiment is used.
Figure 6B:
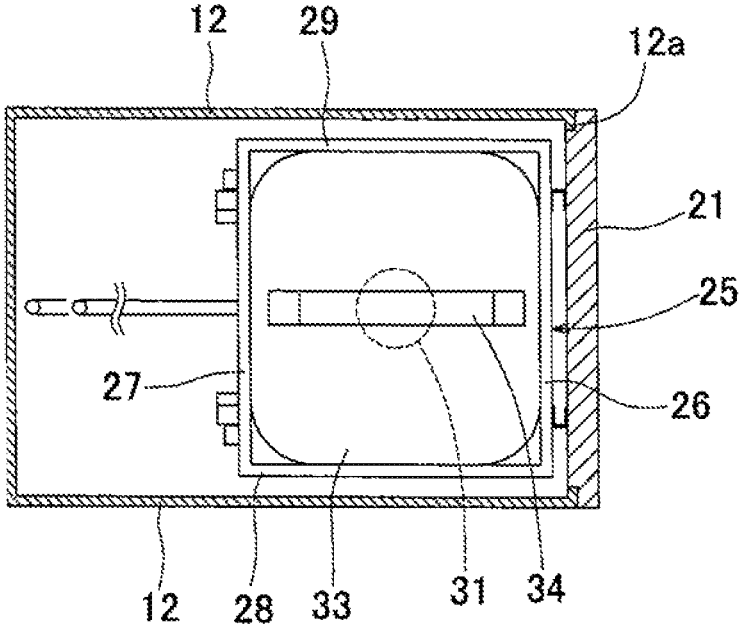
Figure 7:
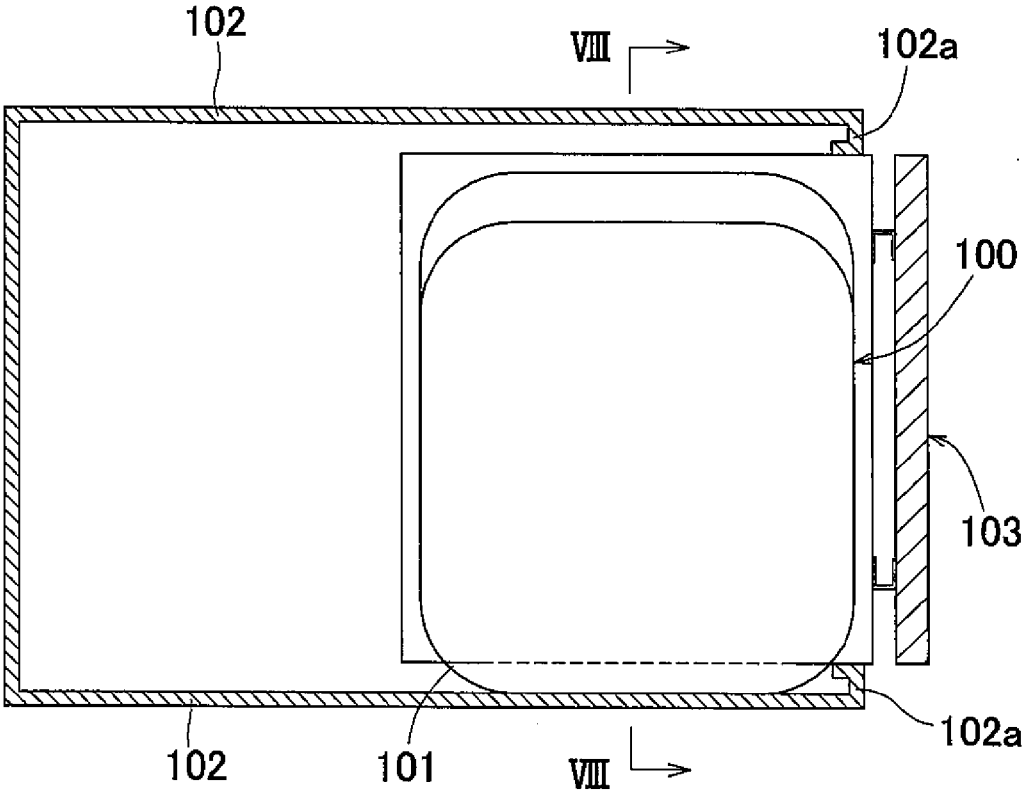
FIG. 7 is a partial top plan view when a conventional slide table is pulled out.
Figure 8:
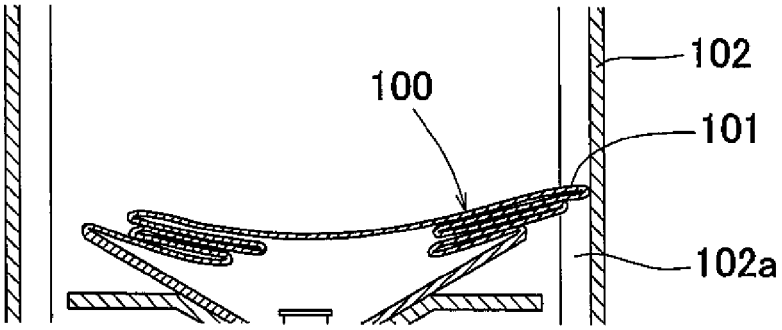
FIG. 8 is a sectional view taken along line VIII-VIII of FIG. 7.

The slide table 20 shown in FIG. 1 includes, as shown in FIGS. 4, 5, 6(*a*) and 6(*b*), a container holder 25 for restraining the peripheral side wall 33 of the raw water container 30 from both sides of the peripheral side wall 33, with the container 30 seated on the seating portion 24. While water is being drawn from the container 30, the peripheral side wall 33 could be collapsed unevenly not only in the right-and-left direction but also in the back and forth direction. The container holder 25 has a front wall portion 26 and a back wall portion 27 for restraining the peripheral side wall from front and back thereof. The container holder 25 further includes a left wall portion 28 and a right wall portion 29 both extending between the front and back wall portions 26 and 27 in the back-and-forth direction and capable of restraining the peripheral side wall 33 when the peripheral side wall 33 is collapsed in any direction.

As shown in FIGS. 1 and 5, the container holder 25 has the lowest height H1 at its intermediate portions 25*a* with respect to the back-and-forth direction. As will be apparent from the comparison between FIGS. 1 and 2, the intermediate portions 25*a* are located on the right and left sides of, and above, the mouth 31 of the raw water container 30 with the raw water container 30 set in the slide table 20 in the upside down position. The lowest height H1 of the container holder 25, which is shown in FIG. 5, is higher than the height h2, namely the seated height of the peripheral side wall 33 of the raw water container 30 when the container 30 becomes empty.

As shown in FIGS. 1, 3 and 6(*b*), the container holder 25, the connecting port 22 and the seating portion 24 form a monolithic bucket member in the embodiment, but instead, the container holder 25 may be provided on the slide table 20 separately from the seating portion 24. The front wall portion 26, back wall portion 27, left wall portion 28, and right wall portion 29 may not be integral with each other. Rather, the portion forming these wall portions may be formed of a plurality of separate members, or may have discontinuous portions so that the container holder 25 can be manufactured and assembled easily, provided the thus formed container holder 25 can sufficiently restrain the peripheral side wall 33. Provided that there is no possibility of the peripheral side wall 33 protruding into spaces behind the front distal end portions 12*a*, it is not necessary that the container holder 25 be in contact with the peripheral side wall 33 when water is initially drawn out of the raw water container 30. However, in order to minimize the dimensions of the container holder 25 in the back-and-forth direction and in the right-and-left direction, the container holder 25 is preferably dimensioned so as to be in contact with the raw water container 30 from the moment when the raw water container 30 is set in the slide table 20. A clearance may be defined between the peripheral side wall 33 and the container holder 25 so that the raw water container 30 can be easily set in the container holder 25, or a larger raw water container 30 can be used, provided the clearance does not make it impossible for the container holder 25 to restrain the peripheral side wall 33.

As shown in FIGS. 1 and 3, an operator (not shown) pulls out the slide table 20, and lifts a raw water container 30 not yet opened and thus filled with raw water over the slide table 20 with the mouth 31 of the container 30 facing downward. Since the front panel 21 of the slide table 20 is higher than the highest point of the container holder 25, and the slide table 20 cannot be pulled out beyond a predetermined limit position, an operator tends to move the raw water container 30 over one of the side walls of the container holder 25. The raw water container 30 is moved until the mouth 31 of the raw water container 30 is moved to the position shown in FIG. 2, namely to the position where there is the connecting port 22. As shown in FIG. 1, since the lowest intermediate portions 25*a* of the container holder 25, whose height is indicated by H1 (see FIG. 5), are located on the right and left sides of, and above, the connecting port 22, the operator can easily align the mouth 31 of the container 30 with the connecting port 22 with reference to one of the intermediate portions 25*a*. Thus, simply by lowering the container 30 from the elevated position, the mouth 31 can be easily set in the connecting port 22, as shown by two-dot chain line in FIG. 5. Since the container 30 is moved over one of the lowest intermediate portions 25*a*, it is not necessary to lift the raw water container 30 to so high a level even though the container holder 25 is used. When the raw water container 30 is lowered by the operator until the mouth 31 is set in the connecting port 22, the raw water container 30 is opened by the piercing portion 23, as shown in FIGS. 2 and 5, so that the water supply line 50 and the air intake line 70 are connected to the raw water container 30. Even if the raw water container 30 hits a portion of the container holder 25, since the container holder 25 is a bucket-shaped member, the container holder 25 prevents a fall of the container 30.

With the raw water container 30 set in the slide table 20, when the operator pushed the slide table 20 all the way in the backward direction, the raw water container 30 is loaded in position in the loading space 11. When the pump 53 is activated thereafter, water is drawn up from the raw water container 30 into the water storage tank unit 40. When the water level in the water storage tank unit 40 rises as a result, air in the water storage tank unit 40 flows through the air introducing pipe 46 and discharged from the second end portion 74 of the air intake line at the air chamber 73. When water remaining in the raw water container 30 decreases, the peripheral side wall 33 gradually collapses under the atmospheric pressure, and its height gradually decreases. While the peripheral side wall 33 is being collapsed, and the internal volume of the raw water container 30 is decreasing, no excessive load is applied to the pump 53 in lifting water from the raw water container 30. While the pump 53 is activated, since the sterilizer 80 is also activated, sterilizing gas in the vertically extending pipe 72 and in the air chamber 73 increases in amount. When the water level in the water storage tank unit 40 reaches its upper limit, the pump 53 is automatically deactivated, and so is the sterilizer 80. Simultaneously, the temperature adjusting functions (heat exchanger 41 and the heater 43) are automatically activated.

Thereafter, when water has been repeatedly discharged through the water discharge lines 60, and the water level sensor detects that the water level in the water storage tank unit 40 has fallen to a predetermined lower limit, the pump 53 is automatically reactivated to replenish water into the tank unit 40 until the upper limit of the water level is reached. After repeated replenishment of water, the rigidity of the peripheral side wall 33, which is bent in a complicated manner, overcomes the atmospheric pressure, so that the reduction in seated height of the peripheral side wall 33 of the raw water container 30 stops at h2.

As shown in FIGS. 5 and 6(*a*), the container holder 25 restrains the peripheral side wall 33 of the raw water container 30 from a sufficiently high position, irrespective of in which direction, namely forwardly, backwardly, rightwardly or leftwardly, the peripheral side wall 33 is unevenly collapsed, thereby preventing excessive protrusion of the peripheral side wall 33 from its original position. The container holder 25 has an upwardly facing distal edge circling around the peripheral side wall 33 at a constant height and having no sharp portions that could wedge into the peripheral side wall 33. Thus, there is no possibility of the peripheral side wall 33 from getting caught on the distal edge of the container holder 25. When the peripheral side wall 33 is collapsed gradually, and its height decreases gradually, the portion of the peripheral side wall 33 which initially protrudes from the container holder 25 is spontaneously pulled into the container holder 25 while being restrained by the container holder 25. The front wall portion 26, back wall portion 27, left wall portion 28 and right wall portion 29, of the container holder 25 have step-free flat surfaces surrounding and restraining the peripheral side wall 33. The peripheral side wall 33 will thus never get caught on any of the wall portions while being collapsed in the container holder 25. As is apparent from FIGS. 5 and 6(*b*), once the peripheral side wall 33 is collapsed until its height decreases below H1 and thus is entirely received in the container holder 25, it becomes impossible for the peripheral side wall 33 to protrude into the spaces behind the front distal end portions 12*a* until the raw water container 30 becomes empty. Since the peripheral side wall 33 never gets caught on any portion of the container holder 25 while the peripheral side wall 33 is being collapsed, until the raw water container 30 becomes empty, the raw water container 30 will never be pulled up by the container holder 25. This in turn prevents leakage of water due to reduced contact pressure between the mouth 31 of the container 30 and the piercing portion 23. In order to achieve the above-mentioned advantages of the invention, the height H1 of the container holder 25 at its lowest portions should be not less than ½ of the total height of a brand-new raw water container 30 (when the container 30 is placed on a horizontal surface). Taking this into consideration, the height H1 of the container holder 25 at its lowest portions is determined so as to be not higher than the peripheral side wall 33 of the raw water container 30 when water is initially drawn from the container 30, namely not higher than the seated height h1. This reduces the height to which the raw water container 30 has to be lifted so as to be moved over one of the left wall portion 28 and the right wall portion 29.

When water remaining in the raw water container 30 further decreases after the peripheral side wall 33 has become uncollapsible any further, atmospheric air is spontaneously introduced into the raw water container 30 through the air intake line 70, shown in FIG. 2, to eliminate negative pressure in the raw water container 30. Since atmospheric air is spontaneously introduced into the raw water container 30, the interior of the raw water container 30 is kept at the atmospheric pressure, even though the volume of the raw water container does not decrease. This prevents excessive load from being applied to the pump 53. Atmospheric air introduced into the raw water container 30 in the form of air bubbles stays in the raw water container 30. When the water level in the raw water container 30 falls below the opening of the first end portion of the water supply line 50, the raw water container 30 becomes empty in the normal sense. The water dispenser includes a sensor which detects that the container 30 has become empty in the normal sense, and is configured to notify this fact and the necessity to exchange the raw water container 30, by e.g. turning on a lamp.

After the container 30 has become empty, the seated height of the peripheral side wall 33 of the raw water container 30 is kept at h2 shown in FIG. 5, until, as shown in FIGS. 1 and 2, the slide table 20 is pulled out of the loading space 11, and the piercing portion 23 is removed from the raw water container 30, for exchange with a new raw water container 30. Thus, while the slide table 20 is being pulled out of the loading space 11 as shown in FIGS. 1 and 2, the peripheral side wall 33 of the now empty raw water container 30 remains within the container holder 25 as shown in FIGS. 5 and 6(*b*), so that the peripheral side wall 33 will never get caught on either of the front distal end portions 12*a* of the side plates 12. The technical scope of this invention is not limited to the above-described embodiments, but encompasses all modifications within the scope of the following claims.

What is claimed is:

1. A water dispenser comprising:

a casing having a loading space at a lower portion of the casing;

a slide table;

an exchangeable raw water container which can be moved into and out of the loading space, while being placed on the slide table;

a water storage tank mounted in the casing;

a water supply line through which water in the raw water container is to be drawn up and supplied into the water storage tank; and a water discharge line through which water in the water storage tank is to be discharged, wherein the loading space is defined by right and left side plates having front distal end portions, respectively, which are bent toward each other, wherein the raw water container is made of a soft material and has a peripheral side wall which is collapsible under an atmospheric pressure when water in the raw water container decreases, wherein the slide table includes a container holder configured to restrain right and left sides of the peripheral side wall of the raw water container when the raw water container is placed on the slide table, wherein the container holder has a minimum height and a predetermined shape, and wherein the minimum height and the predetermined shape are determined such that when the peripheral side wall of the raw water container is collapsed, the raw water container is never pulled up by the container holder as a result of the peripheral side wall getting caught on the container holder, and such that when the raw water container becomes empty, the raw water container is received within the container holder, wherein the raw water container has a plug, wherein the slide table has a piercing portion which can push the plug upwardly into the raw water container, wherein the piercing portion includes a first end portion of the water supply line, and wherein the minimum height of the container holder constitutes a lowest overall portion of an upper end edge of the container holder and is determined so as to be not higher than the peripheral side wall of the raw water container when water in the raw water container is initially drawn out.

2. A water dispenser comprising:

a casing having a loading space at a lower portion of the casing;

a slide table;

an exchangeable raw water container which can be moved into and out of the loading space, while being placed on the slide table;

a water storage tank mounted in the casing;

a water supply line through which water in the raw water container is to be drawn up and supplied into the water storage tank; and a water discharge line through which water in the water storage tank is to be discharged, wherein the loading space is defined by right and left side plates having front distal end portions, respectively, which are bent toward each other, wherein the raw water container is made of a soft material and has a peripheral side wall which is collapsible under an atmospheric pressure when water in the raw water container decreases, wherein the slide table includes a container holder configured to restrain right and left sides of the peripheral side wall of the raw water container when the raw water container is placed on the slide table, wherein the container holder has a minimum height and a predetermined shape, and wherein the minimum height and the predetermined shape are determined such that when the peripheral side wall of the raw water container is collapsed, the raw water container is never pulled up by the container holder as a result of the peripheral side wall getting caught on the container holder, and such that when the raw water container becomes empty, the raw water container is received within the container holder, wherein the raw water container has a main container portion and a mouth arranged such that when the raw water container is positioned upside down, the mouth protrudes downwardly from the main container portion of the raw water container such that the mouth is the lowermost portion of the raw water container, and wherein the container holder has intermediate portions located on both sides of, and above, the mouth of the raw water container with the raw water container placed on the slide table in an upside down position, the intermediate portions having said minimum height which constitutes a lowest overall portion of an upper end edge of the container holder and is determined so as to be not higher than the peripheral side wall of the raw water container when water in the raw water container is initially drawn out.

3. The water dispenser of claim 1, wherein the raw water container has a main container portion and a mouth arranged such that when the raw water container is positioned upside down, the mouth protrudes downwardly from the main container portion of the raw water container such that the mouth is the lowermost portion of the raw water container, and wherein the container holder has intermediate portions located on both sides of, and above, the mouth of the raw water container with the raw water container placed on the slide table in an upside down position, the intermediate portions having the said minimum height which constitutes a lowest overall portion of an upper end edge of the container holder.

4. The water dispenser of claim 3, wherein the upper end edge of the container holder has a downwardly recessed portion located at the intermediate portions.

5. The water dispenser of claim 2, wherein the upper end edge of the container holder has a downwardly recessed portion located at the intermediate portions.

* * * * *